United States Patent [19]

Newton et al.

[11] 4,095,607

[45] Jun. 20, 1978

[54] COIN HANDLING APPARATUS

[75] Inventors: Gerald E. Newton; Emilio A. Caccamo, both of Philadelphia, Pa.

[73] Assignee: Mars, Incorporated, McLean, Va.

[21] Appl. No.: 689,747

[22] Filed: May 25, 1976

[30] Foreign Application Priority Data

Jun. 2, 1975 United Kingdom ..... 23834/75

[51] Int. Cl.[2] ..... G07D 3/04

[52] U.S. Cl. ..... 133/1 A; 133/3 D; 194/1 K

[58] Field of Search ..... 194/1 K, 1 D, DIG. 14; 133/1 R, 1 A, 2, 3 R, 3 A–3 H, 4 R, 4 A

[56] References Cited

U.S. PATENT DOCUMENTS

| | | | |
|---|---|---|---|
| 3,204,648 | 9/1965 | Rumer et al. | 133/2 |
| 3,844,297 | 10/1974 | Lautzenhiser | 133/1 A |
| 3,906,965 | 9/1975 | Luyben et al. | 194/1 K X |

*Primary Examiner*—Robert B. Reeves
*Assistant Examiner*—Fred A. Silverberg
*Attorney, Agent, or Firm*—Davis, Hoxie, Faithfull & Hapgood

[57] ABSTRACT

Apparatus comprising at least one coin tube having a fixed capacity, a chute for receiving coins of a predetermined diameter and directing them towards the tube, and a guide associated with the chute and the tube for causing coins to be directed into the tube when it is filled to less than its capacity and past the tube when it is filled to its capacity.

19 Claims, 4 Drawing Figures

COIN HANDLING APPARATUS

The present invention is concerned with an improvement in coin handling apparatus suitable for incorporation in a coin operated vending machine. Such coil handling apparatus receives coins of various denominations, determines the denomination and authenticity of the coins, rejects slugs and coins of unacceptable denominations, determines and sums the denominations of acceptable coins to a value equal to or in excess of the price of the item to be vended have been inserted, and produces change in an amount equal to the excess of the value of the accepted coins over the price of the item selected.

A coin inserted into a vending machine having such apparatus enters the apparatus and moves by gravity along a series of coin tracks which establish a sinuous coin path. Sensors arranged along the coil path measure one or more physical properties of the coil such as electrical conductivity, diameter, acceleration, velocity, or functions which depend on combinations of these properties. Circuitry associated with the sensors determines whether the coin is an authentic coin of an acceptable denomination. If not, the coil is rejected. An accepted coin travels under gravity along a further track past one or more acceptance windows arranged in order of increasing height in the direction of coil travel. Each acceptance window leads via a chute to a coin tube appropriate for coins of a particular denomination. The height of each acceptance window corresponds to the diameter of acceptable coins. A coil falling through one of the acceptance windows is guided down the associated chute and then across the mouth of the associated coin tube. Each coin tube is dimensioned to store a supply of stacked coins sufficient to meet anticipated change-giving requirements, and a dispensing mechanism at the foot of each tube may be actuated by circuitry in the apparatus to dispense the proper change. Coins larger than any of the acceptance windows continue under gravity along a further path to a locked coin box, in which accepted coins of all denominations are stored for periodic removal. When the value of accepted coins exceeds the price of the desired item, the excess is determined by the circuitry, and the appropriate change is dispensed from one or more of the tubes. When a coin tube is full, it is desired that further coins issuing from the associated chute slide across the top coin in the tube, by-passing the tube, and enter a further or overflow chute that leads to the coin box.

It has been recognized for some time that coin jams can occur at the top of a full coin tube in any coin handling apparatus when for some reason a coin fails to slide completely across the top coin in the tube. A number of means for insuring that additional coins approaching the mouth of a full coin tube are directed past the tube have been proposed.

British Pat. No. 308,045 suggests tilting all the coins in the vertical tube so that when the tube is filled the uppemost coin forms an inclined sliding surface for succeeding coins, directing them past the tube into a coin box. (Page 5, column 1 and FIG. 10)

Hatcher's U.S. Pat. No. 2,780,336 recognizes that when a vertically oriented coin tube is full, coins approaching it in a horizontal direction may slide over the top coin and on to a coin box. (Column 13, lines 11–24 and FIG. 28)

Rumer's U.S. Pat. No. 3,204,648 discloses a pivotally mounted member that lies in the path of coins falling edgewise vertically down a slot and supposedly causes them to enter a coin tube in a tilted manner. According to that specification, the rear portion of a tilted entering coin will not clear a shoulder at the top of the tube when the tube is nearly full, and that coin and succeeding ones will be held in a tilted stack rising up to the lip of the coin tube and deflecting additional coins past the tube and on to a cash box. (FIGS. 3–6 and accompanying text.) None of these disclosed means, however, provides reliable and satisfactory results.

One invention directed to the problem employs means for imparting rolling motion to the approaching coin so that interference between the edge of that coin and the uppermost coin in the coin tube is minimized and the front of the moving coin does not engage the uppermost coin in the tube. That invention is disclosed in U.S. Pat. No. 3,906,965 which is assigned to the assignee of the present invention.

According to the present invention, an apparatus is provided for stacking coins comprising a substantially vertical open-topped coin tube, chute means having a coin slide surface for directing coins edge first to the top of the coin tube and means extending inwardly of the inner surface of the top of the coin tube at the upstream and downstream portions of the tube. The inwardly extending means cooperate to retain a coin in an orientation in which the upper surface of the coin forms an extension of the coin slide surface of the chute when the tube is filled to its capacity, thereby insuring the successful transit of succeeding coins past the full tube to the coin box. Except for the uppermost coin or coins in the tube, all coins in the tube are stacked horizontally.

Throughout this specification the term "coin" is intended to mean genuine coins, tokens, counterfeit coins, slugs, washers, and any other item which may be used in an attempt to use coin-operated devices.

It should also be understood that while the invention will be discussed with respect to a single coin tube, its use on all coin tubes contained in a coin handling apparatus is equally within the scope of the present invention.

Figure 1:
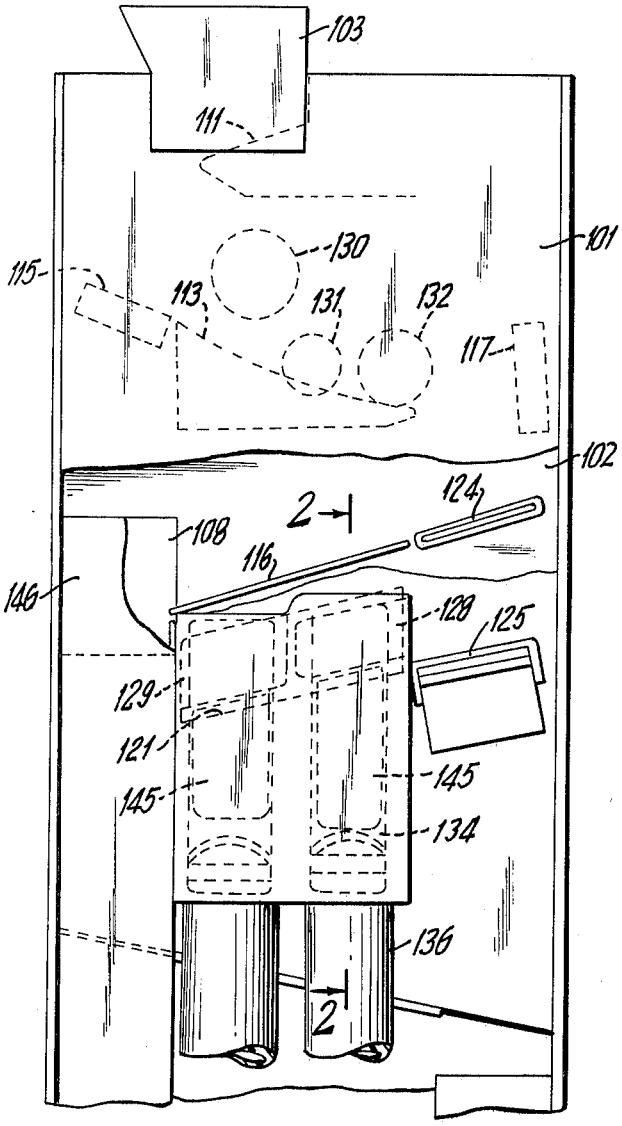
FIG. 1 is a partial rear elevational view of apparatus including the present invention.

Referring to FIG. 1, a coin inserted into the coin-receiving slot (not shown) of a vending machine of the type incorporating the present invention is directed into a hopper 103. The coin drops from the hopper onto a track 111 and rolls down the track between front and rear plates 101 and 102. At the end of track 111 the coin drops onto a pad 115, which absorbs or dissipates a substantial portion of the kinetic energy of the coin to reduce coin bouncing. The coin rolls down the upper surface of the pad 115 and onto a track 113. As the coin rolls downstream along the track 113, it is identified by means incorporating one or more of sensors 130, 131 and 132. By the time the coin reaches the end of the track 113, it has been identified as either acceptable or unacceptable, and if acceptable, it has been further identified as to denomination.

At the end of the track 113, the momentum of the coin carries it across to a second substantially vertical pad 117. The pad 117, similar to pads 115 and 125, causes the dissipation or absorption of most of the kinetic energy of the coin, allowing it to drop almost vertically toward an acceptance gate 124. If the coin has been identified as acceptable, the gate 124 is retracted into the rear plate 102, allowing the coin to fall past the gate 124 toward a pad 125. If the coin has been identified as unacceptable, the gate 124 intercepts the coin, diverting it onto a track 116. The coin rolls down the track 116, entering a reject chute 146 at 108. The reject chute 146 delivers the rejectd coin to the coin window of the vending machine.

As mentioned above, a coin identified as acceptable drops past the retracted acceptance gate 124 onto the pad 125 behind a separator plate 104 as viewed in FIG. 1. These pads may be energy absorbing devices as disclosed in U.K. Specification 23883/73, filed May 18, 1973 and assigned to the assignee of the present invention. Alternatively, the pads may be constructed of a block of a hard material such as aluminum oxide, as disclosed in the specification of U.K. Application No. 54318/73. In either case, the pads cause absorption or dissipation of the kinetic energy of the moving coin to reduce coin bouncing.

After dropping onto the pad 125, the accepted coin rolls down onto a track 121 which passes acceptance windows 128 and 129. Windows 128 and 129 are graded in height from smaller to larger. As more fully disclosed in U.S. Pats. Nos. 3,844,297 and 3,906,965 and both assigned to the assignee of the present invention, all coins of appropriate diameter fall through a predetermined window and down an associated coin chute.

Figure 2:
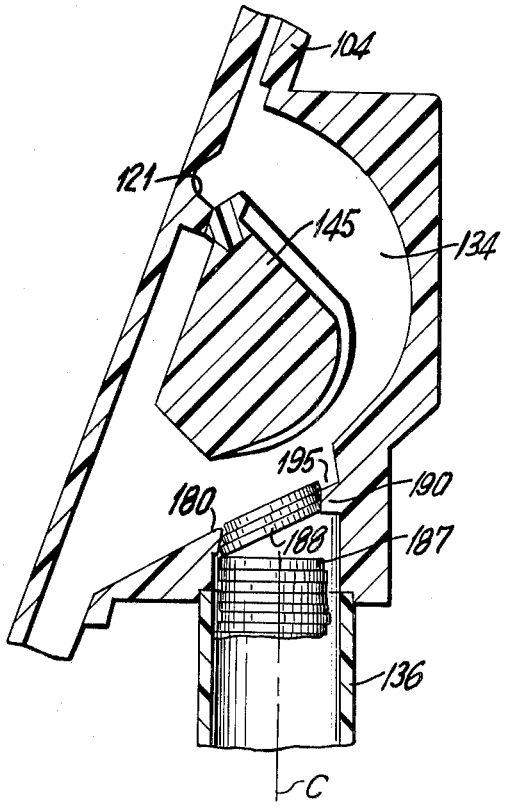
FIG. 2 is a sectional view taken along the line 2-2 of a portion of the apparatus of FIG. 1.

Referring now specifically to the present invention as shown in FIG. 2, applied to one coin denomination, a coin which falls through window 128 is guided down the associated coin chute 134 to the top of the associated coin tube 136. Initially, a coin falling through the window 128 is guided to the coin slide surface of chute 134 by a block 145, the upper surface of which is cambered or pitched downward in the direction of coin travel along track 121 as shown in FIG. 2. In practice block 145 is not mounted perpendicular to the track 121 as indicated in FIG. 1, but instead is mounted approximately 85 degrees from the direction of coin travel down the track. The block directs the coin to the coin slide surface of the chute and also prevents it from randomly tumbling down the chute in a manner likely to cause jamming. On reaching the rear wall the coin continues to slide downward, but the generally arcuate contour of the coin slide surface gradually changes the direction of coin motion somewhat towards horizontal.

Figure 3:
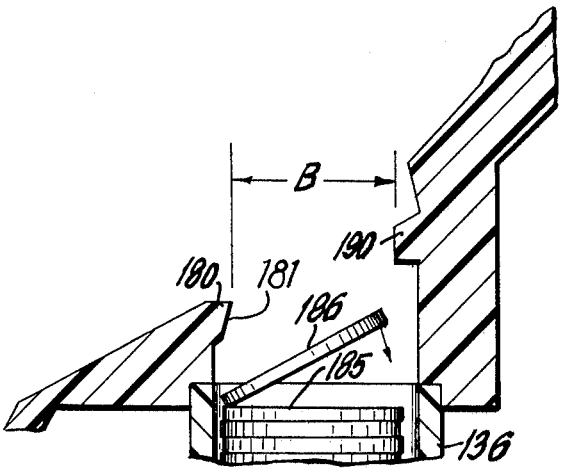
FIG. 3 is a sectional view of a portion of the apparatus shown in FIG. 2, showing its operation with a coin tube only partially filled.

The trajectory of each coin as it leaves the coin slide surface at the top of the coin tube may be preferably about 45 degrees from horizontal. As the downstream edge of an approaching coin reaches the space above the coin tube and simultaneously moves beyond the coin slide surface of chute 134, the coin will tend to pitch forward and fall into the coin tube 136. The tube is shown as being vertically oriented, but it should be understood that as long as its axis C is substantially vertical, within about 10 degrees of vertical, the device will reliably operate as disclosed herein, without the occurrence of coin jams. If the horizontal stack of coins in tube 136 is low enough, as shown in FIG. 3, the downstream edge of the arriving coin 186 will fall sufficiently far into tube 136 before stopping against the uppermost coin 185 in the stack to permit the upstream edge of the coin to clear upstream shoulder 190. In this condition the entering coin 186 will come to rest horizontally on top of the stack.

Figure 4:
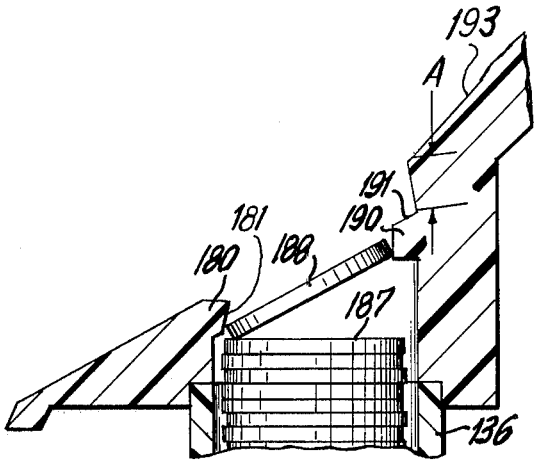
FIG. 4 is a sectional view similar to FIG. 3 but showing the operation of the present invention with a full coin tube.

If the coin tube is nearly full, the present invention reliably orients the uppermost coins to prevent jamming of the apparatus by the arrival of succeeding coins. As indicated in FIG. 4, when the horizontal coin stack in tube 136 is high, the downstream edge of an arriving coin 188 does not move far enough into the tube before impacting the uppermost horizontally stacked coin 187 to allow the upstream edge of clear shoulder 190. When this occurs, the coin 188 comes to rest oriented in a tilted position, with the downstream edge resting on the uppermost horizontal coin in the tube stack 187 and the upstream edge resting against shoulder 190.

Subsequently arriving coins are similarly arranged on top of coin 188. The upstream facing surface 181 of downstream overhang 180, against which the downstream edges of succeeding coins rest, halts each succeeding tilted coin slightly further upstream from those that preceded it. This upstream skewing of the tilted stack, together with the distance, denoted A in FIG. 4, between the coin slide surface 193 of the chute and the shelf surface 191 of shoulder 190, ensures that no coins can become jammed in the space indicated by numeral 195 in FIG. 2 between the upstream ends of the tilted coins and the end of the chute wall. The shelf surface 191 is formed by a rabbet interposed between the coin slide surface and the shoulder. If the shelf surface 191 of shoulder 190 was not depressed below the coin slide surface of the chute by the distance A, the downstream edge of an additional arriving coin could catch below the upstream edge of a tilted coin, thereby causing a jam. The minimum satisfactory distance A will depend on the height of the upstream facing surface 181 of overhang 180, for reasons explained in the next paragraph, but in any case will never be less than the characteristic thickness of the coins.

The height of the upstream facing surface 181 determines how many coins will be held in the tilted position before additional coins are sent on to the coin box. Because the thickness of individual coins varies somewhat from the characteristic thickness because of manufacturing tolerances and wear, the variation amounting to about 1 coin thickness over the total height of the stack, it has been found advantageous to provide sufficient height for the upstream facing surface to hold at least 2 coins in the tilted orientation.

When the full design complement of coins are so oriented, the upstream facing surface 181 of overhang 180 will be below the upper surface of the uppermost coin, so that additional arriving coins will slide over the uppermost coin, seeing it as an extension of the coin slide surface, and on past the coin tube.

When the level of the horizontal coin stack in tube 136 drops, when coins are dispensed from the tube, the downstream edge of the first tilted coin 188 will move downward and permit the rear edge of that coin to clear shoulder 190. The coin will then fall flat into the tube.

Upstream facing surface 181 of overhang 180 performs an additional function of preventing any arriving coins from assuming a backward tilt that could cause a jam. The downstream edge of coins arriving at the top of tube 136 strike the downstream side of the coin tube with some velocity and normally have a tendency to rebound upwardly. In the absence of overhang 180, the downstream edge of a coin arriving at a nearly full tube could rebound upwardly, causing the coin to come to rest in a backward tilting orientation. The upstream tilt of the face 181 of overhang 180 prevents upward movement of an arriving coin and thereby eliminates this cause of coin jamming.

It will be apparent that the means extending inwardly of the inner surface of the top of the coin tube at the upstream and downstream portions of the tube function by preventing arriving coins from falling into the tube unless those coins are able to tilt some predetermined amount with respect to the axis of the tube. In other words, the distance, measured along the stream direction perpendicular to the axis of the coin tube, between the innermost extents of the inwardly extending means must be less than the characteristic diameter of the coins. As shown in FIG. 3, distance B must be smaller than the diameter of coins 185, 186, etc. Similarly, to permit a sufficiently tilted coin to fall into the coin tube, the diameter of the open top of the tube, measured across the stream direction perpendicular to the coin tube axis, must be greater than the characteristic diameter.

It will also be apparent that the inwardly extending means need not be one-piece constructions; they could each equally be made up of two or more means each extending inwardly from the inner surface of the tube at the upstream or downstream portion of the tube.

The present device operates in a simple, reliable manner to prevent jams caused by full coin tubes. It will perform as rapidly as coins are inserted into the machine, having no moving parts. It can be applied to one or more denominations of coins accepted by the vending machine.

We claim:

1. Apparatus for handling coins of one denomination having a characteristic thickness and diameter comprising:

an open-topped coin tube having a substantially vertical central axis and having a predetermined capacity for retaining facially stacked coins, chute means having a downwardly inclined coin slide surface for directing coins to the open top of the coin tube and across the top of the tube when it is filled to capacity, wherein the improvement comprises means extending inwardly of the inner surface of the coin tube at its top on the upstream and on the downstream sides of the coin tube with respect to the coin slide surface incline, for retaining an oriented coin in a jam prevention orientation by upstream skewing in which the upper surface of the coin forms an extension of the coin slide surface of the chute when the coin tube is filled to the capacity of the coin tube.

2. The apparatus of claim 1 wherein the means extending inwardly at the upstream portion of the coin tube is a shoulder for supporting the oriented coin that forms the slide surface extension.

3. The apparatus of claim 2 wherein the distance, measured perpendicular to the coin tube axis, between the innermost extent of the inwardly extending means at the upstream and downstream portions of the coin tube is less than the characteristic diameter.

4. The apparatus of claim 2 wherein the diameter of the open top of the coin tube, measured across the stream direction perpendicular to the coin tube axis, is greater than the characteristic diameter.

5. The apparatus of claim 2 wherein the shoulder is for supporting a plurality of oriented coins, the uppermost of which is the coin that forms the slide surface extension.

6. The apparatus of claim 5 wherein the distance, measured perpendicular to the coin tube axis, between the innermost extent of the inwardly extending means at the upstream and downstream portions of the coin tube is less than the characteristic diameter.

7. The apparatus of claim 5 wherein the diameter of the open top of the coin tube, measured across the stream direction perpendicular to the coin tube axis, is greater than the characteristic diameter.

8. The apparatus of claim 5 wherein the means extending inwardly at the downstream side of the coin tube is an overhang having a surface facing upstream with respect to the coin slide incline for abutting the downstream edge of each of the plurality of oriented coins, said surface extending upwardly no farther than the abutted downstream edge of the uppermost coin of the plurality of the oriented coins.

9. The apparatus of claim 8 wherein the distance, measured perpendicular to the coin tube axis, between the innermost extent of the inwardly extending means at the upstream and downstream portions of the coin tube is less than the characteristic diameter.

10. The apparatus of claim 8 wherein the diameter of the open top of the coin tube, measured across the stream direction perpendicular to the coin tube axis, is greater than the characteristic diameter.

11. The apparatus of claim 8 wherein interposed between the shoulder and the coin slide surface of the chute is a rabbet which forms, at the top of the shoulder, a shelf surface for supporting the oriented coin that forms the slide surface extension.

12. The apparatus of claim 11 wherein the distance, measured perpendicular to the coin tube axis, between the innermost extent of the inwardly extending means at the upstream and downstream portions of the coin tube is less than the characteristic diameter.

13. The apparatus of claim 11 wherein the diameter of the open top of the coin tube, measured across the stream direction perpendicular to the coin tube axis, is greater than the characteristic diameter.

14. The apparatus of claim 11 wherein the shelf surface is depressed below the coin slide surface of the chute a distance at least equal to the characteristic thickness multiplied by an integer.

15. The apparatus of claim 14 wherein the distance, measured perpendicular to the coin tube axis, between the innermost extent of the inwardly extending means at the upstream and downstream portions of the coin tube is less than the characteristic diameter.

16. The apparatus of claim 14 wherein the diameter of the open top of the coin tube, measured across the stream direction perpendicular to the coin tube axis, is greater than the characteristic diameter.

17. The apparatus of claim 1 wherein the distance, measured perpendicular to the coin tube axis, between the innermost extent of the inwardly extending means at the upstream and downstream sides of the coin tube is less than the characteristic diameter.

18. The apparatus of claim 17 wherein the diameter of the open top of the coin tube, measured across the stream direction perpendicular to the coin tube axis, is greater than the characteristic diameter.

19. The apparatus of claim 1 wherein the diameter of the open top of the coin tube, measured across the stream direction perpendicular to the coin tube axis, is greater than the characteristic diameter.

* * * * *

UNITED STATES PATENT AND TRADEMARK OFFICE

CERTIFICATE OF CORRECTION

PATENT NO. : 4,095,607

DATED : June 20, 1978

INVENTOR(S) : Gerald E. Newton and Emillio A. Caccamo

It is certified that error appears in the above-identified patent and that said Letters Patent are hereby corrected as shown below:

Col. 1, lines 6, 19, 20, 25, 28 and 33 "coil" should be --coin--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*